US006792837B2

(12) United States Patent
Battistone

(10) Patent No.: US 6,792,837 B2
(45) Date of Patent: Sep. 21, 2004

(54) UNIVERSAL RETAINING RING PLIER TOOL

(75) Inventor: Nicola Battistone, Richmond Heights, OH (US)

(73) Assignee: Stride Tool, Inc., Ellicottville, NY (US)

( * ) Notice: Subject to any disclaimer, the term of this patent is extended or adjusted under 35 U.S.C. 154(b) by 0 days.

(21) Appl. No.: 10/273,230

(22) Filed: Oct. 17, 2002

(65) Prior Publication Data

US 2004/0074348 A1 Apr. 22, 2004

(51) Int. Cl.[7] ..... B25B 7/012

(52) U.S. Cl. ..... 81/302; 29/229; 81/486; 81/485

(58) Field of Search ..... 81/302, 300, 416, 81/486, 485; 29/229, 268

(56) References Cited

U.S. PATENT DOCUMENTS

| | | | |
|---|---|---|---|
| 1,122,165 | A | 12/1914 | Schoening |
| 2,546,616 | A | 3/1951 | Schaaff |
| 3,619,890 | A | 11/1971 | Kubokawa |
| 3,662,449 | A | 5/1972 | Hashimoto |
| 4,280,265 | A | 7/1981 | Murphy |
| 4,476,750 | A | 10/1984 | Murphy |
| 4,625,379 | A | 12/1986 | Anderson |
| 4,793,224 | A | 12/1988 | Huang |
| 5,007,313 | A | 4/1991 | Jeromson, Jr. et al. |
| 5,327,802 | A | 7/1994 | Yu |

*Primary Examiner*—Hadi Shakeri
(74) *Attorney, Agent, or Firm*—Benesch Friedlander Coplan & Aronoff LLP

(57) ABSTRACT

A plier tool having first and second jaws independently and rotatably disposed about a pivot. A pair of handles are rotatably disposed about the same pivot. The handles are attached on opposite sides of the jaws by a bolt that passes through openings in the handles and through the center of the jaws. The handles are capable of being alternately engaged with the jaws by a pair of pivoting members such that the tool is changeable between a first position where the first jaw is engaged with the first handle and the second jaw is engaged with the second handle and a second position where the first jaw is engaged with the second handle and the second jaw is engaged with the first handle. In this manner, the tool can be switched from an internal retaining ring plier to an external retaining ring plier.

8 Claims, 5 Drawing Sheets

UNIVERSAL RETAINING RING PLIER TOOL

FIELD OF INVENTION

The present invention relates generally to plier tools such as retaining or snap ring pliers. More particularly, the present invention relates to pliers of a type which are convertible between a first position which allows the jaws to move inwardly as the handles are moved inwardly and a second position which allows the jaws to move outwardly as the handles are moved inwardly.

BACKGROUND OF THE INVENTION

Retaining rings are utilized in annular grooves on shafts and ends of shafts to retain bearings, collars, and the like on the shaft. A retaining ring extends circumferentially between a pair of ends which are formed to have hubs. The hubs have apertures in which are inserted tips of a plier tool and force applied to either spread the hubs to expand the ring or squeeze the hubs to contract the ring, as necessary for installing the ring in and removing the ring from either external or internal grooves.

It is thus sometimes considered desirable to squeeze (move inwardly) the handles to effect movement of the jaws outwardly to expand the ring. It is at other times considered desirable to squeeze the handles to effect movement of the jaws inwardly to contract the ring. Thus, it is desirable to provide a plier which is convertible between an external and an internal tool. U.S. Pat. Nos. 4,280,265 and 4,476,750 disclose a pair of retaining ring pliers which utilize a pair of separate coplanar jaws and a pair of separate handles arranged about a common fixed pivot point having a pair of fulcrum points adapted to alternately engage one handle then another to change the fulcrum point to permit the changing of the tool from an external to an internal tool. Two fulcrum pins are disposed in the jaws and adapted to alternately engage each set of handles to shift the fulcrum point from a position adapted to move the jaws inwardly as the handles are moved inwardly to a position where the jaws are moved outwardly as the handles are moved inwardly. It may be difficult for the user of the pliers of the above patents to slide the pins into position.

What is needed is a convertible plier tool that is easier to manipulate between the internal and external configuration.

SUMMARY OF THE INVENTION

The present invention meets the above-described need by providing first and second jaws independently and rotatably disposed about a pivot. A separate pair of handles are rotatably disposed about the same pivot. The handles attach on opposite sides of the jaws by a bolt that passes through openings in the handles and through the center of the jaws. The jaws have a recessed portion with a bearing surface that abuts with the tops of the handles. The handles are capable of being alternately engaged with the jaws such that the tool is changeable between a first position where the first jaw in engaged with the first handle and the second jaw is engaged with the second handle and a second position where the first jaw is engaged with the second handle and the second jaw is engaged with the first handle. In this manner, the tool can be switched from an internal retaining ring plier to an external retaining ring plier. When the tool is set for external rings, the jaws move outwardly when the handle moves inwardly. When the tool is set for internal rings the jaws move inwardly when the handles are moved inwardly. The jaws have openings at the back ends for engaging with pivoting members attached to the handles.

In a disclosed embodiment, a first pivoting member is attached to the first handle and has a pair of key elements that are sized to fit into the openings in the first jaw or the second jaw. The first pivoting member pivots about a centrally located pivot such that when it is rotated in one direction one of its key elements enters the first jaw. When the pivoting member is rotated in the opposite direction, the key element on the opposite side of the pivot enters the second jaw. Accordingly, the key members on the first pivoting member enable the member to alternately engage with either jaw pending on which way the pivoting member is rotated.

A second pivoting member is attached to the second handle and pivots about a pivot that aligns with the pivot for the first pivoting member. The second pivoting member also has a pair of key elements that operate in the same manner as described above such that the second pivoting member is capable of engaging the second handle to either the first jaw or the second jaw depending on which way the second pivoting member is rotated.

Each pivoting member has a lever arm attached to one end such that the members can be manually rotated from first positions where the first handle is engaged with the second jaw and the second handle is engaged with the first jaw to second positions where jaw to handle engagements are reversed.

BRIEF DESCRIPTION OF THE DRAWINGS

The invention is illustrated in the drawings in which like reference characters designate the same or similar parts throughout the figures of which.

DETAILED DESCRIPTION OF THE PREFERRED EMBODIMENTS

Figure 1:
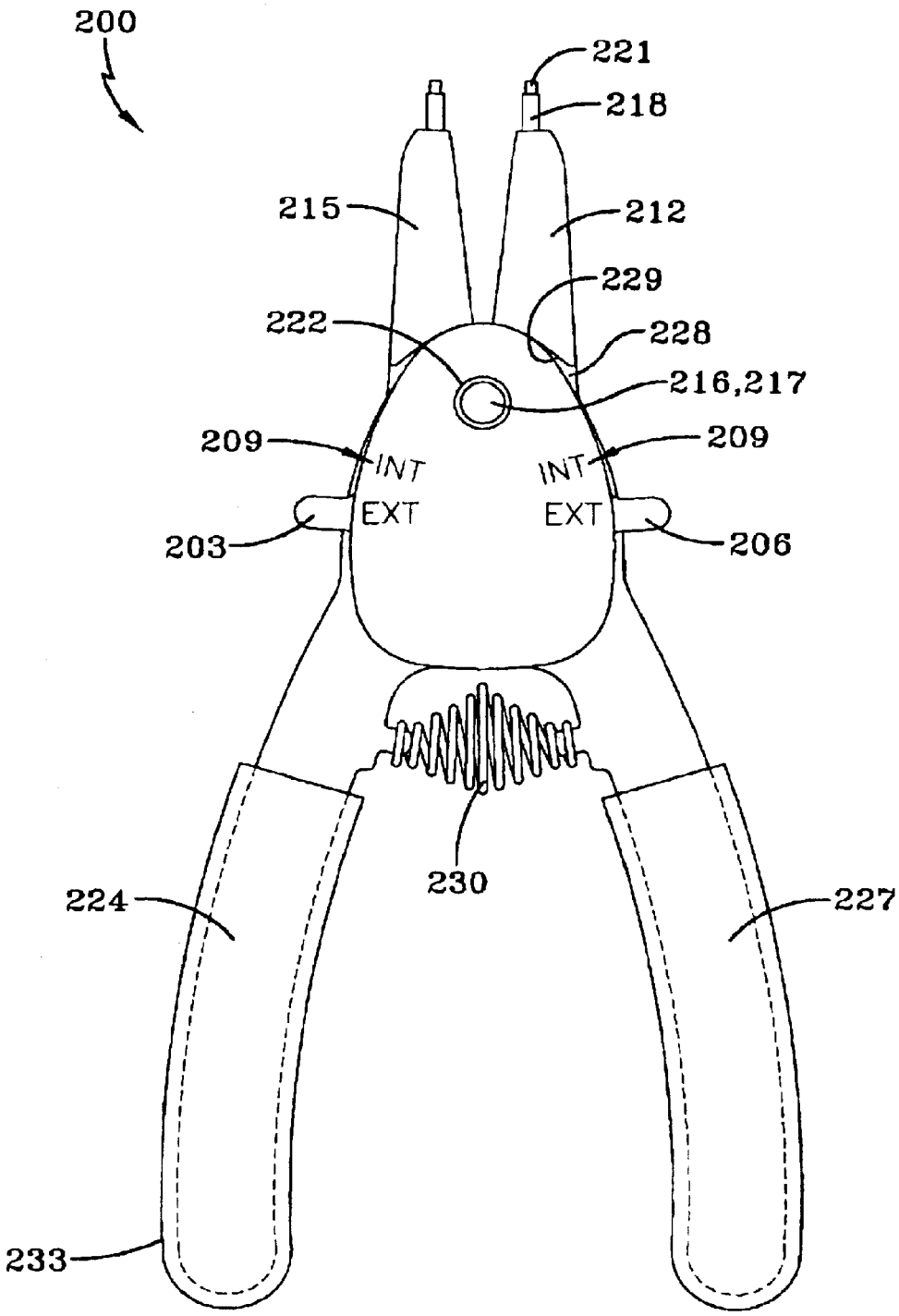
FIG. 1 is a plan view the tool of the present invention.

Referring to FIG. 1, there is shown generally a plier tool 200 used for inserting and removing a retaining ring. The plier tool 200 has a first lever arm 203 and a second lever arm 206 for switching the tool between the internal and the external configuration. A set of indicia 209 indicates the configuration of the tool. A right jaw 212 and a left jaw 215 pivot about a pivot 216. The pivot is preferably provided by a bolt 217. The jaws 212, 215 have tips 218 each with a reduced diameter section 221 for engaging with the apertures in standard retaining rings. The jaws 212, 215 rotate independently about the pivot 216 and are held in position by the bolt 217 which extends through the jaws and through openings 222 in handles 224, 227. The jaws each have a recessed portion 228 with a bearing surface 229 that abuts with the top of the handles 224, 227. The jaws 212, 215 are capable of being alternately connected with handles 224 and 227 to switch between internal and external mode.

When the tool 200 is in the external configuration, the jaws 212, 215 move outwardly when the handles 224, 227 are moved inwardly. When the tool 200 is in the internal configuration the jaws 212, 215 move inwardly when the handles move inwardly.

A spring 230 is disposed between the handles 224, 227 to bias the handles 224, 227 apart from one another. The handles 224, 227 have plastic covers 233 that provide for better gripping and cushioning for the user.

Figure 2:
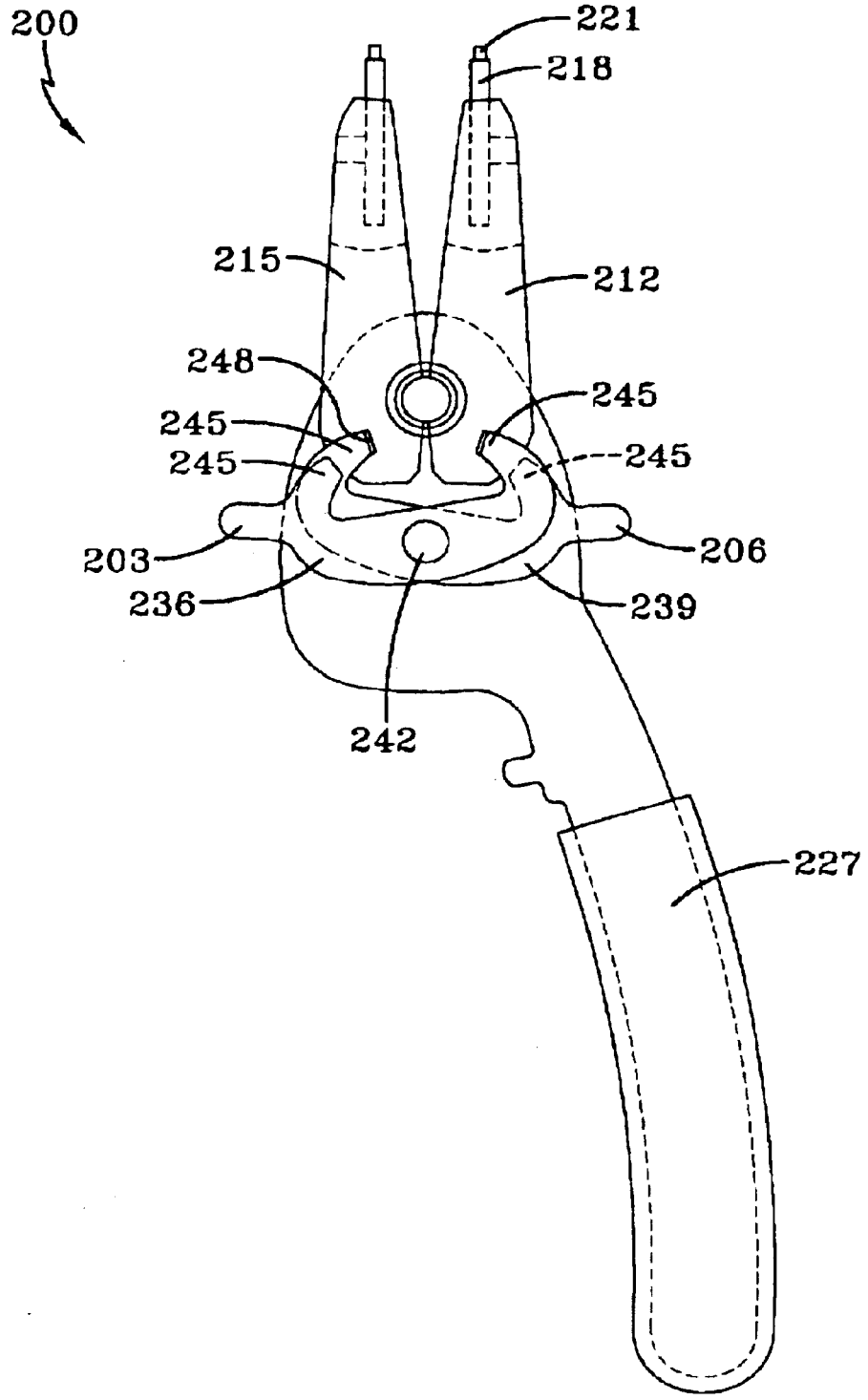
FIG. 2 is a partial plan view of the tool.
Figure 3:
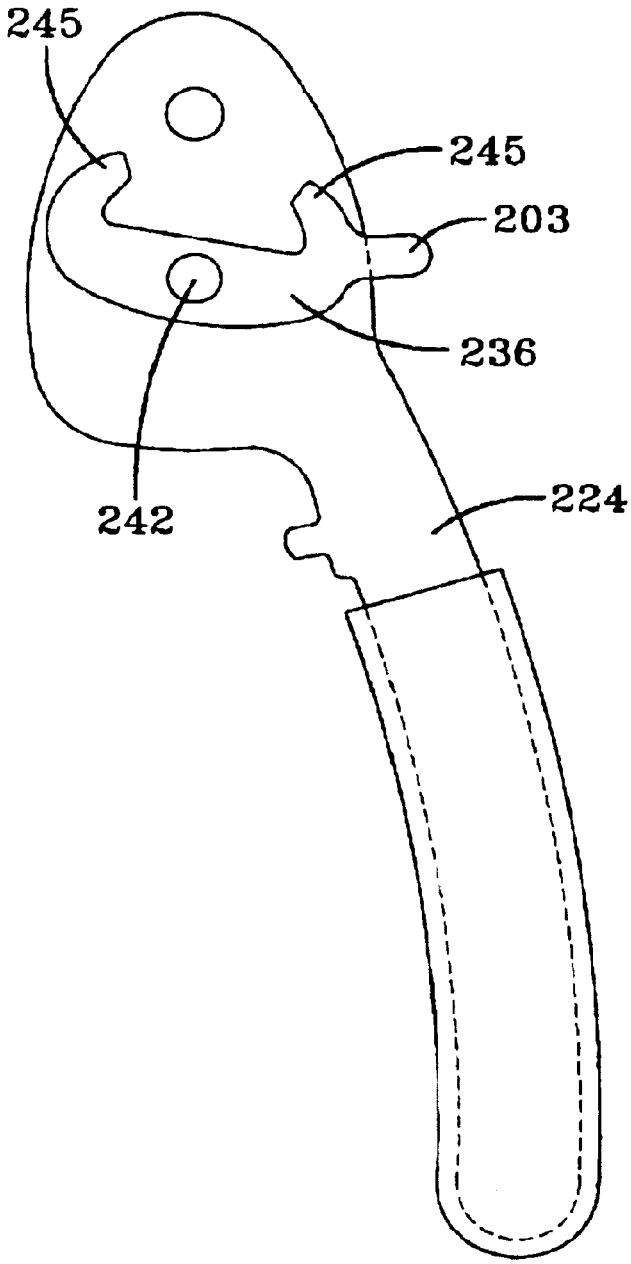
FIG. 3 is a plan view of the second pivoting member and the second handle for the tool.

Turning to FIG. 2, the lever arm 203 extends from a first pivoting member 236 and the lever arm 206 extends from a second pivoting member 239. The pivoting members 236, 239 rotate about a pivot 242. Each of the pivoting members 236, 239 has a pair of keys 245 extending therefrom and sized to be capable of engaging with walls of openings 248 in the jaws 212, 215. The tool 200 is switched between the internal and external configuration by manually rotating the lever arms 203, 206 and the connected pivoting members 236, 239 such that the keys 245 engage with the jaws 212, 215. In FIG. 3, the first pivoting member 236 and the first handle 224 are shown.

In operation, the jaws 212, 215 are alternately connected to the first and second handles 224, 227 depending on the position of the manually pivoting members 236, 239.

Figure 4:
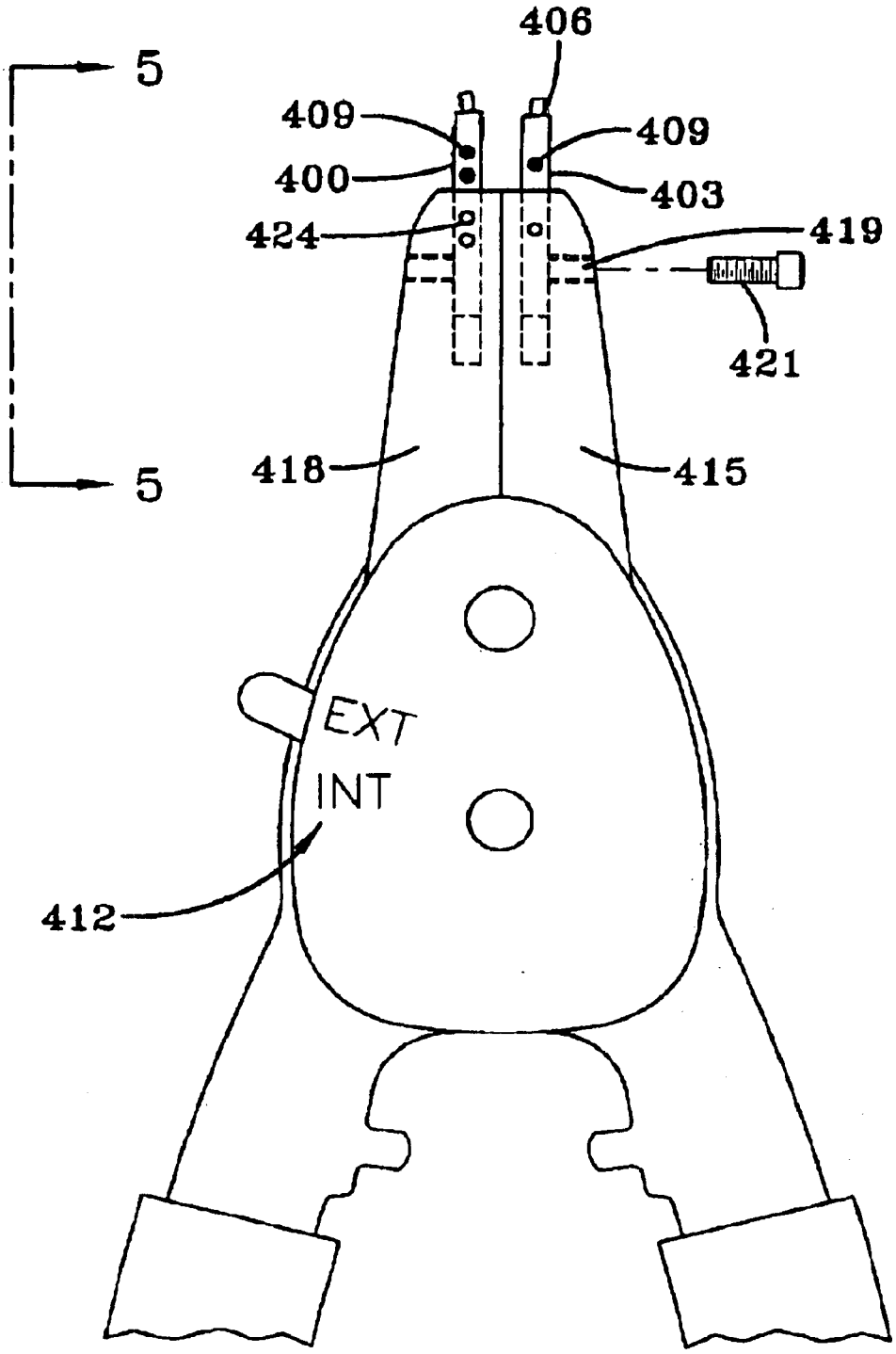
FIG. 4 is a plan view of an additional embodiment.

Turning to FIG. 4, a pair of tips 400 and 403 have reduced diameter portions 406 that are inserted into the retaining ring apertures. The reduced diameter portions 406 are angled away from each other for external rings. For internal rings, the tips 400, 403 are rotated 180 degrees such that the reduced diameter portions 406 are angled toward one another and almost in contact with each other.

The tips 400 and 403 preferably contain color coded indicia 409 for internal and external positioning of the tips that correspond to color coded indicia 412 for the internal and external engagement of the jaws and handles. The tips 400 and 403 preferably have one color on one side and another color on the opposite side. The right jaw 415 and left jaw 418 have openings 419 for set screws 421 and sight openings 424. The sight openings 424 align with the color indicia 409 when the tips 400 and 403 are inserted fully into the jaws 415, 418. If the tips 400 and 403 are installed properly, the color visible in the sight opening 424 matches the color indicia 412.

Figure 5:
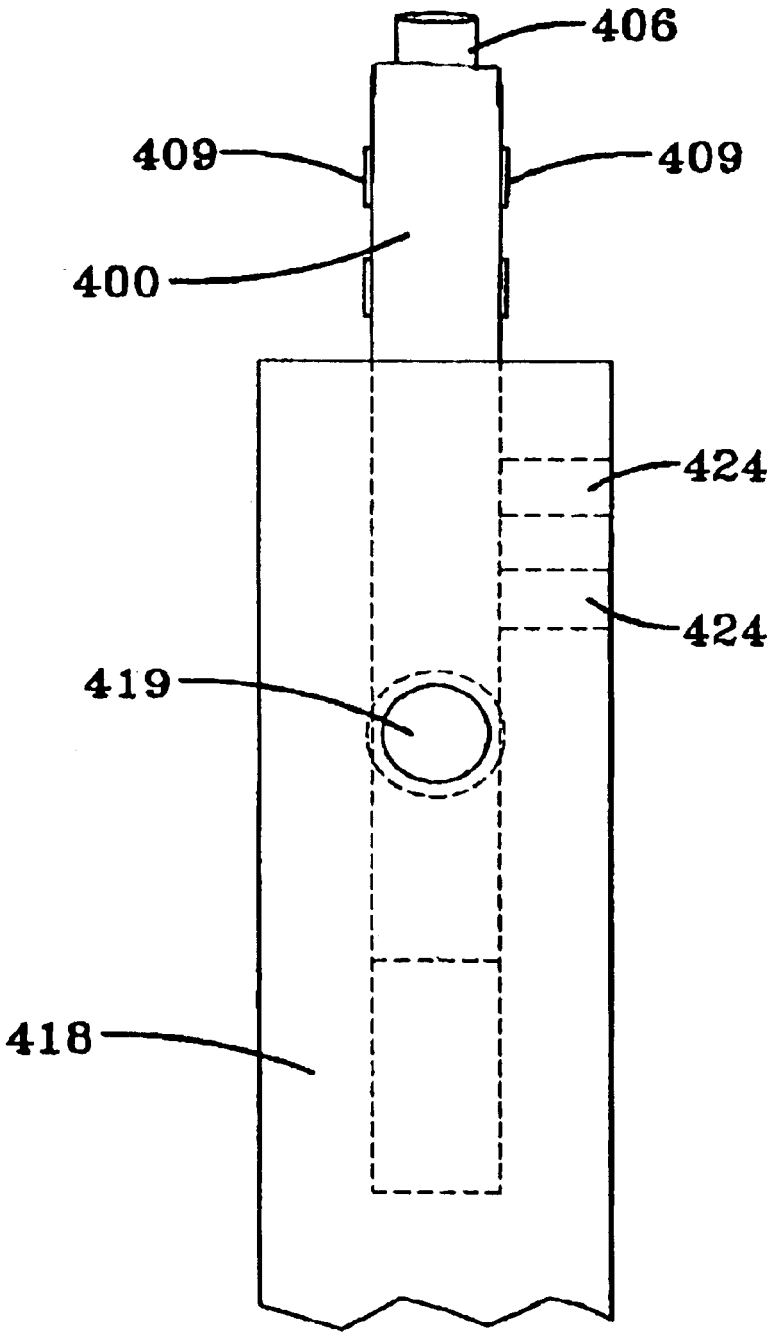
FIG. 5 is a view taken along line 5—5 of FIG. 4.

Turning to FIG. 5, the indicia 409 are disposed on both sides of the tips. To switch from internal to external the tip is removed from the jaw and rotated 180 degrees.

The present invention provides several advantages, including ease of use, reliability, and ease of manufacture. The invention also provide easier switching between the internal and external positions.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed:

1. A plier tool, comprising:

a pivot defining a pivot axis;

first and second jaws independently and rotatalby disposed about the pivot;

first and second handles rotatably disposed about the pivot;

a first pivoting member attached to the first handle, rotatable about an axis substantially parallel to the pivot axis, and having a lever arm and at least two key elements, one of the at least two key elements being capable of engaging with the first jaw and another of the at least two key elements being capable of engaging with the second jaw;

a second pivoting member attached to the second handle, rotatable about an axis substantially parallel to the pivot axis, and having a lever arm and at least two key elements, one of the at least two key elements being capable of engaging with the first jaw and another of the at least two key elements being capable of engaging with the second jaw.

2. The plier tool of claim 1, further comprising a pair of tips each having a reduced diameter portion, the tips being capable of engaging with the jaws in a first position where the reduced diameter portions are angled toward each other and a second position where the reduced diameter portions are angled away from each other.

3. The plier tool of claim 2, wherein the tips each have indicia on both sides of the tip such that a first indicia corresponds to the first position and a second indicia corresponds to the second position.

4. The plier tool of claim 3, wherein the jaws have slight holes for viewing the indicia on the tips when the tips are inserted into the jaws.

5. The plier tool of claim 4, wherein a second set of indicia disposed adjacent to the lever arm indicate an internal and an external configuration and correspond to the indicia on the tip such that the position of the tips for the internal configuration and the external configuration can be ascertained by matching the second set of indicia with the indicia on the tips.

6. The plier tool of claim 1, wherein movement of the pivoting members causes the plier tool to alternate between a first position where the first pivoting member engages the first handle to the first jaw and the second pivoting member engages the second handle to the second jaw and a second position where the first pivoting member engages the first handle to the second jaw and the second pivoting member engages the second handle to the first jaw.

7. The plier tool of claim 1, wherein each jaw has an opening at an end that is sized to receive the key elements.

8. The plier tool of claim 1, further comprising a spring connected between the first and second handles such that the plier tool is spring biased to urge the handles apart.

* * * * *